US009523551B2

(12) United States Patent
Iannello

(10) Patent No.: US 9,523,551 B2
(45) Date of Patent: Dec. 20, 2016

(54) TACTICAL RAIL ENGAGING ASSEMBLY

(71) Applicant: ILLINOIS TOOL WORKS INC., Glenview, IL (US)

(72) Inventor: Christopher A. J. Iannello, Rolling Meadows, IL (US)

(73) Assignee: Illinois Tool Works Inc., Glenview, IL (US)

( * ) Notice: Subject to any disclaimer, the term of this patent is extended or adjusted under 35 U.S.C. 154(b) by 47 days.

(21) Appl. No.: 14/372,467

(22) PCT Filed: Jan. 16, 2013

(86) PCT No.: PCT/US2013/021682

§ 371 (c)(1),
(2) Date: Jul. 16, 2014

(87) PCT Pub. No.: WO2013/109590

PCT Pub. Date: Jul. 25, 2013

(65) Prior Publication Data

US 2014/0360079 A1 Dec. 11, 2014

Related U.S. Application Data

(60) Provisional application No. 61/587,709, filed on Jan. 18, 2012.

(51) Int. Cl.
*F41C 23/16* (2006.01)
*F41G 11/00* (2006.01)

(52) U.S. Cl.
CPC ..... *F41C 23/16* (2013.01); *F41G 11/003* (2013.01)

(58) Field of Classification Search
CPC ..... F41G 11/00; F41C 23/16; F41C 23/00; F41C 23/22
(Continued)

(56) References Cited

U.S. PATENT DOCUMENTS 6,487,807 B1 * 12/2002 Kopman ..... F41A 23/12 42/72
6,499,245 B1 12/2002 Swan
(Continued)

FOREIGN PATENT DOCUMENTS

DE 20303993 U1 9/2003
DE 102008005698 A1 7/2009

OTHER PUBLICATIONS

ISR and WO for PCT/US2013/021682 mailed Jun. 19, 2013.

*Primary Examiner* — Jonathan C Weber
(74) *Attorney, Agent, or Firm* — Joseph M. Butscher; The Small Patent Law Group, LLC

(57) ABSTRACT

A tactical rail engaging assembly may include a securing base having opposed first and second lateral walls connected to opposed first and second end walls. A rail-receiving channel may be formed through a surface of the securing base. At least one button may be formed through at least one of the first and second end walls. At least one rail lock may extend between the first and second lateral walls and have at least one surface extending into the rail-receiving channel in an extended state. The button(s) is operatively connected to the rail lock(s). The button(s) is configured to be engaged to move the surface of the rail lock(s) from the extended state to a retracted state in order to allow at least a portion of the tactical rail to move within the rail-receiving channel relative to the securing base.

18 Claims, 10 Drawing Sheets

(58) Field of Classification Search
USPC ..... 42/71.01, 71.02, 72, 73, 90, 94
See application file for complete search history.

(56) References Cited

U.S. PATENT DOCUMENTS

| | | | | | |
|---|---|---|---|---|---|
| 7,111,424 | B1 * | 9/2006 | Moody | F41A 23/08 | 248/171 |
| 7,243,454 | B1 * | 7/2007 | Cahill | F41C 23/12 | 42/72 |
| 7,421,815 | B1 * | 9/2008 | Moody | F41C 23/16 | 248/171 |
| 7,559,167 | B1 * | 7/2009 | Moody | F41G 11/003 | 42/71.01 |
| 7,568,304 | B1 * | 8/2009 | Moody | F41A 23/08 | 42/71.01 |
| 7,665,239 | B1 * | 2/2010 | Moody | F41A 23/08 | 42/72 |
| 7,845,105 | B1 | 12/2010 | Cahill | | |
| 7,861,451 | B1 * | 1/2011 | Moody | F41A 23/08 | 42/71.01 |
| 7,900,390 | B2 * | 3/2011 | Moody | F41A 23/08 | 42/71.01 |
| 7,987,623 | B1 * | 8/2011 | Moody | F41A 23/08 | 42/71.01 |
| 8,109,032 | B2 * | 2/2012 | Faifer | F41C 23/16 | 362/110 |
| 8,136,284 | B2 * | 3/2012 | Moody | F41A 23/08 | 42/71.01 |
| 8,215,047 | B2 * | 7/2012 | Ash, Jr. | F41C 23/14 | 42/71.01 |
| 8,245,428 | B2 * | 8/2012 | Griffin | F41C 23/16 | 42/72 |
| 8,341,866 | B1 * | 1/2013 | Gaddini | F41G 11/003 | 42/71.01 |
| 8,393,104 | B1 * | 3/2013 | Moody | F41C 23/14 | 42/71.01 |
| 9,010,008 | B2 * | 4/2015 | Hovey | F41C 23/16 | 42/72 |
| 2002/0100204 | A1 * | 8/2002 | Kim | F41G 1/35 | 42/146 |
| 2005/0188588 | A1 * | 9/2005 | Keng | F41C 23/16 | 42/72 |
| 2005/0241206 | A1 * | 11/2005 | Teetzel | F41C 23/16 | 42/72 |
| 2006/0191183 | A1 * | 8/2006 | Griffin | F41C 23/16 | 42/72 |
| 2006/0277809 | A1 * | 12/2006 | Moody | F41A 23/08 | 42/72 |
| 2007/0271832 | A1 * | 11/2007 | Griffin | F41C 23/16 | 42/72 |
| 2008/0052979 | A1 * | 3/2008 | Lee | F41A 23/04 | 42/94 |
| 2008/0276518 | A1 * | 11/2008 | Moody | F41A 23/08 | 42/72 |
| 2009/0038200 | A1 * | 2/2009 | Keng | F41A 23/10 | 42/94 |
| 2009/0056192 | A1 * | 3/2009 | Oz | F41C 23/16 | 42/94 |
| 2009/0193702 | A1 * | 8/2009 | Lin | F41C 23/16 | 42/72 |
| 2010/0005696 | A1 * | 1/2010 | Moody | F41C 23/16 | 42/94 |
| 2010/0031551 | A1 * | 2/2010 | Griffin | F41C 23/16 | 42/72 |
| 2010/0229450 | A1 | 9/2010 | Becker et al. | | |
| 2010/0307043 | A1 * | 12/2010 | Moody | F41A 23/08 | 42/72 |
| 2011/0179688 | A1 * | 7/2011 | Ash, Jr. | F41C 23/16 | 42/72 |
| 2012/0096755 | A1 * | 4/2012 | Griffin | F41C 23/14 | 42/105 |

* cited by examiner

TACTICAL RAIL ENGAGING ASSEMBLY

RELATED APPLICATIONS

This application is a National Phase of International Application Number PCT/US2013/021682 filed Jan. 16, 2013 and relates to and claims priority benefits from U.S. Provisional Patent Application No. 61/587,709 entitled "Foregrip Assembly," filed Jan. 18, 2012, which is hereby incorporated by reference in its entirety.

FIELD OF EMBODIMENTS OF THE DISCLOSURE

Embodiments of the present disclosure generally relate to a tactical rail engaging assembly, and more particularly, to a tactical rail engaging assembly configured to quickly and easily engage a tactical rail, such as used in military applications.

BACKGROUND

Various devices include graspable or gripping members that allow a user to comfortably and efficiently utilize the device. For example, various weapons, such as automatic firearms, have relatively long barrels. Instead of directly grasping the barrel, which may be hot, a soldier may grasp a foregrip positioned along the firearm. In this manner, the soldier is able to steady the firearm and more easily aim the weapon, for example.

A Picatinny rail, otherwise known as a tactical rail, includes a bracket used on some firearms, for example, in order to provide a standardized mounting platform, which may be used to mount accessories such as scopes, grenade launchers, and the like. A typical Picatinny rail includes a series of ridges having a T-shaped cross-section separated by flat spacing slots. Scopes, for example, may be mounted either by sliding them on the rail from an end, through a weaver mount that is clamped to the rail with bolts, thumbscrews, levers, or the like, or onto slots between ridges. A Picatinny rail may be used with various accessories, such as scopes, tactical lights, laser aiming modules, grenade launchers, night vision devices, reflex sights, foregrips, bipods, and bayonets. Picatinny rails typically have standardized dimensions, such as a slot width of 0.206" (5.23 mm), spacing between slot centers of 0.394" (10.01 mm) and slot depth of 0.118" (3.00 mm). In this manner, the Picatinny rails are configured to accommodate interchangeable accessories.

Typically, a tactical rail accessory, such as a foregrip, includes four separate and distinct securing pins that each need to be simultaneously engaged in order to secure the foregrip to a Picatinny rail system. However, engaging each of the four pins and pulling them downward is awkward, and may prove difficult while still holding onto a heavy weapon. Indeed, manipulating and adjusting a typical foregrip with one hand may prove difficult.

SUMMARY OF EMBODIMENTS OF THE DISCLOSURE

Certain embodiments of the present disclosure provide a tactical rail engaging assembly configured to securely engage a tactical rail. The tactical rail engaging assembly may include a securing base having opposed first and second lateral walls connected to opposed first and second end walls. A rail-receiving channel may be formed through a surface of the securing base. At least one button may be formed through at least one of the first and second end walls. At least one rail lock may extend between the first and second lateral walls and have at least one surface extending into the rail-receiving channel in an extended state. The button(s) may be operatively connected to the rail lock(s). The button(s) is configured to be engaged to move the surface(s) of the rail lock(s) from the extended state to a retracted state in order to allow at least a portion of the tactical rail to move within the rail-receiving channel relative to the securing base.

The button(s) may include first and second buttons located at the first and second walls, respectively. The rail lock(s) may include first and second rail locks extending between the first and second lateral walls. At least one spring member may abut into at least a portion of the rail lock(s).

The assembly may also include a graspable member connected to the securing base. The assembly may be a foregrip assembly, for example. However, the assembly may be various other components, devices, or the like.

An end cap may be removably secured to the graspable member. The graspable member may include a hollow interior chamber closed by the end cap.

The assembly may also include at least one rail segment extending from one or both of the first and second lateral walls. The rail segment(s) may be configured to securely retain a component, such as an accessory, device, or the like.

The rail segment(s) may be integrally formed with the first and/or second lateral walls. The rail segment(s) may be removably secured to the first and/or second lateral walls.

One or both of the first and second lateral walls may include a connection post and first and second securing anchors. The rail segment(s) may securely connect to the first and/or second lateral walls through the connection post and the first and second securing anchors.

The rail segment(s) may include a body having a slot and a pivot beam extending into the slot. The pivot beam may include a free stud at a terminal end. A component is configured to connect to the body through, at least in part, the free stud.

Certain embodiments of the present disclosure provide a tactical rail engaging assembly configured to securely engage a tactical rail. The tactical rail engaging assembly may include a securing base having opposed first and second lateral walls connected to opposed first and second end walls. A rail-receiving channel may be formed through a surface of the securing base. The rail-receiving channel may be configured to receive at least a portion of the tactical rail. A first rail segment may extend from the first lateral wall. A second rail segment may extend from the second lateral wall. Each of the first and rail segments may be configured to securely retain a component.

Each of the first and second rail segments may be integrally formed with the first and second lateral walls, respectively. Optionally, one or both of the first and second rail segments may be removably secured to one or both of the first and second lateral walls, respectively.

One or both of the first and second lateral walls may include a connection post and first and second securing anchors. One or both of the first and second rail segments may securely connect to one or both of the first and second lateral walls through the connection post and the first and second securing anchors.

One or both of the first and second rail segments may include connection channels configured to securely connect to the connection post and the first and second securing anchors. The connection channels include one or more of reciprocal channels formed through or within one or both of the first and second rail segments.

One or both of the first and second rail segments may include a body having a slot and a pivot beam extending into the slot. The pivot beam may include a free stud at a terminal end. The component is configured to connect to the body through, at least in part, the free stud.

Certain embodiments of the present disclosure provide a tactical rail configured to receive and retain a component. The tactical rail may include at least one rail segment including a body having a slot and a pivot beam extending into the slot. The pivot beam may include a free stud at a terminal end. The component is configured to connect to the body in a securing connection through, at least in part, the free stud. A reciprocal feature of the component is configured to receive and retain the free stud or be securely positioned between the free stud and a portion of the body. The pivot beam is configured to be manipulated to remove the free stud from the securing connection with the free stud.

The rail segment(s) may include connection channels configured to receive and retain portions of a securing base. The connection channels may be configured to secure to a connection post and first and second securing anchors of the securing base.

Figure 2:
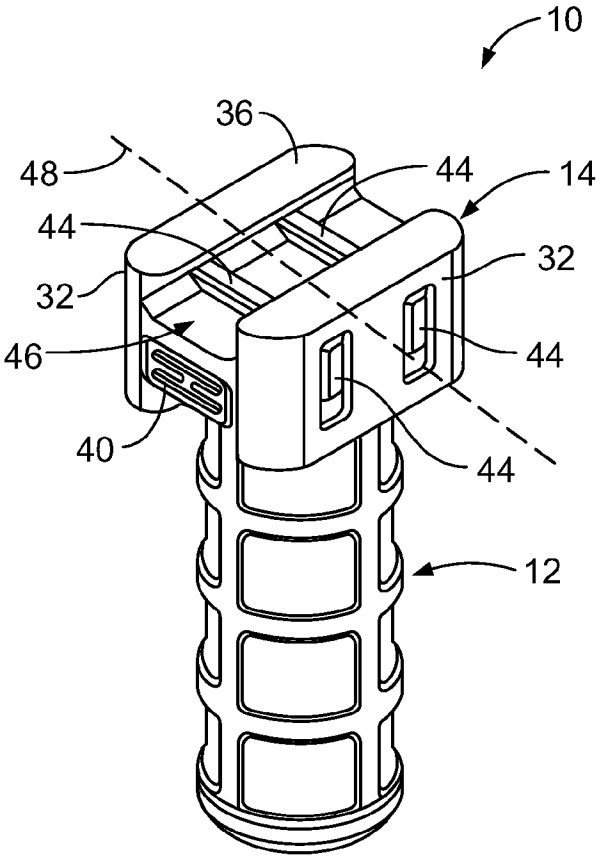
FIG. 2 illustrates an isometric top view of a tactical rail engaging assembly, according to an embodiment of the present disclosure.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE DISCLOSURE

Figure 1:
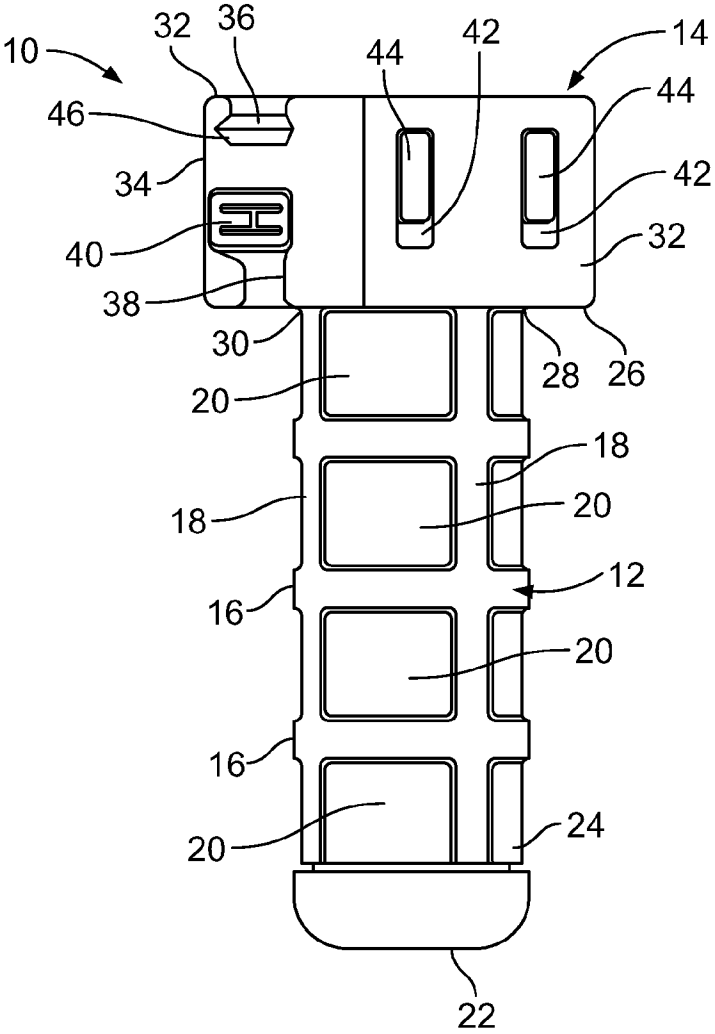
FIG. 1 illustrates an isometric front view of a tactical rail engaging assembly, according to an embodiment of the present disclosure.

FIG. 1 illustrates an isometric front view of a tactical rail engaging assembly 10, according to an embodiment of the present disclosure. The tactical rail engaging assembly 10 may be a foregrip assembly configured to be secured to a tactical rail, such as that of a weapon, for example. The tactical rail engaging assembly 10 includes a graspable member 12, such as a post, handle, rod, column, or the like, integrally formed with a securing base 14, such as a platform, block, or the other such housing. The graspable member 12 may be a generally cylindrical structure having multiple horizontal and vertical gripping ribs 16 and 18, respectively, separated by recessed areas 20. The gripping ribs 16, 18 and recessed areas 20 provide tactile features configured to allow an operator to readily and securely grip. Various other tactile features may be used in addition to, in or instead of, the gripping ribs 16, 18 and the recessed areas 20. Additionally, optionally, the graspable member 12 may not include all of the gripping ribs 16, 17 and recessed areas 20. For example, the graspable member 12 may be a smooth cylinder.

An end cap 22 may be removably secured to a distal end 24 of the graspable member 12. The end cap 22 may include a threadable interface configured to threadably engage an internal threadable interface at the distal end 24 of the graspable member 12 in order to allow the end cap 22 to be removed from the distal end 24, and later secured thereto. The graspable member 12 may include a hollow interior chamber, for example, that may be accessed by way of the end cap 22 being removed from the distal end 24. Alternatively, the end cap 22 may be secured to the distal end 24 through various other structural features. For example, the end cap 22 may be secured to the distal end 24 through a latch and pivotal hinge, separate and distinct fasteners, adhesives, and/or the like. Also, alternatively, the graspable member 12 may not include the end cap 22.

The securing base 14 may be perpendicular to the graspable member 12 and may be distally located from the end cap 22. The securing base 14 may include a main body 26 having a bottom surface 28 integrally connected to a proximal end 30 of the graspable member 12. The bottom surface 28 connects to opposed lateral walls 32 and opposed end walls 34, which, in turn, connect to an upper surface 36.

Button cavities 38 are formed through each end wall 34. Each button cavity 38 is configured to receive and retain a button 40.

Lock channels 42 are formed through each lateral wall 32. Each lock channel 42 is configured to receive and retain a rail lock 44 that spans between the opposed lateral walls 32.

A rail-receiving channel 46 is formed through the upper surface 36. The rail-receiving channel 46 extends from each end wall 34 over a length of the securing base 14. The rail-receiving channel 46 is generally perpendicular to the rail locks 44. The rail-receiving channel 46 is sized and shaped to receive a securing platform of a tactical rail, such as a Picatinny rail.

FIG. 2 illustrates an isometric top view of the tactical rail engaging assembly 10. In a fully-extended position, each rail lock 44 extends upwardly into the rail-receiving channel 46. The tactical rail engaging assembly 10 is shown having two rail locks 44 centered about a lateral axis 48. For example, one rail lock 44 is a distance from the lateral axis 48, while a second rail lock 44 is the same distance from the lateral axis 48, but on the opposite side of the lateral axis 48. More or less rail locks 44 than those shown may be used. In operation, as explained below, the buttons 40 are configured to be engaged, such as by pressing inwardly, in order to move the rail locks 44 downwardly into an internal chamber of the securing base 14. As the rail locks 44 move downwardly into the internal chamber, the rail locks 44 recede from the rail-receiving channel 46. In this manner, a securing platform of a tactical rail may be slid into the rail-receiving channel 46. Once the tactical rail is moved to a desired position, the buttons 40 are disengaged, and the rail locks 44 move upwardly back into the rail-receiving channel 46 to lock the tactical rail in place.

Figure 3:
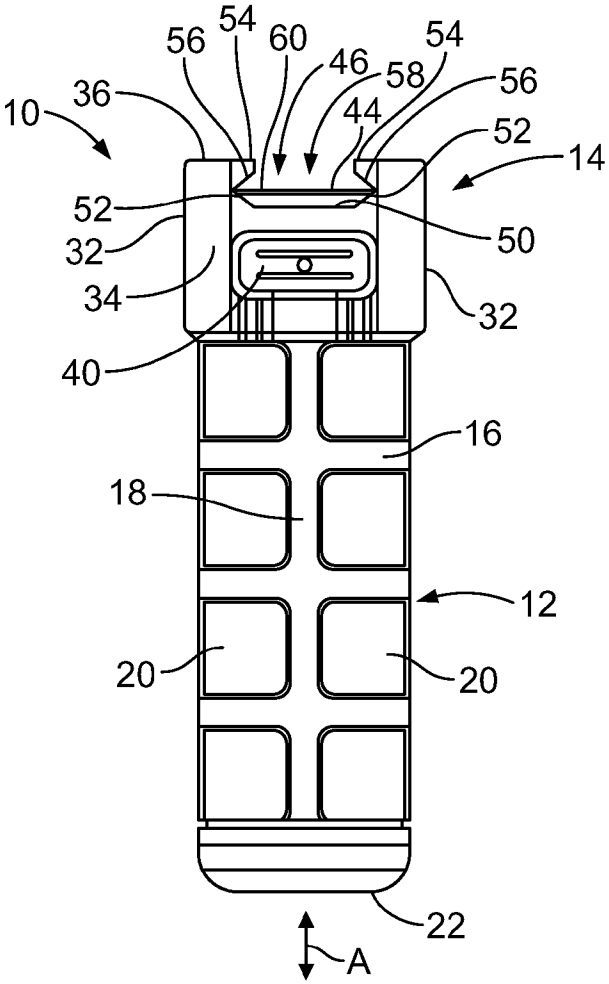
FIG. 3 illustrates an end view of a tactical rail engaging assembly, according to an embodiment of the present disclosure.

FIG. 3 illustrates an end view of the tactical rail engaging assembly 10. The ends of the tactical rail engaging assembly 10 may be mirror images of one another. The rail-receiving channel 46 formed through the upper surface 36 may be defined by a flat surface 50 connected to opposed lateral edges 52. An angle of the lateral edges 52 with respect to the flat surface 50 may be obtuse. The lateral edges 52, in turn, connect to inwardly-canted edges 54 (above the lateral edges 52) defined by ledges 56. The angle between the inwardly-canted edges 54 and the lateral edges 52 may be acute. The ledges 56 are separated by a clearance space 58. The rail-receiving channel 46 is sized and shaped to allow a securing platform of a tactical rail to be slid therein. The rail-receiving channel 46 may be defined by various other shapes and sizes, depending on the size and shape of a particular securing platform that is configured to be received within the rail-receiving channel 46.

As shown in FIG. 3, the rail locks 44 extend upwardly into the rail-receiving channel 46 when the buttons 40 are not engaged by an individual. However, when the buttons 40 are pressed inward, the rail locks 44 recede downwardly into the securing base 14 so that upper engaging surfaces 60 of the rail locks 44 are generally flush or below the plane of the flat surface 50.

Figure 4:
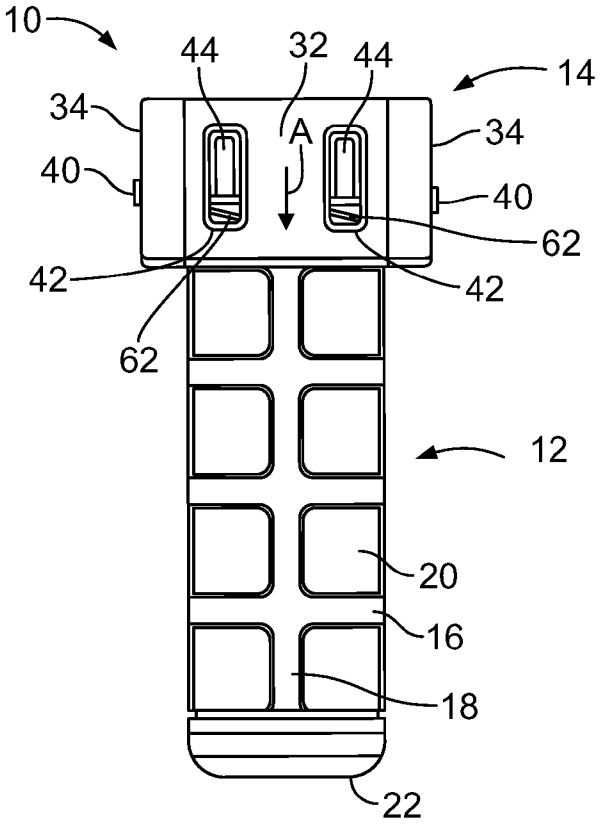
FIG. 4 illustrates a lateral view of a tactical rail engaging assembly, according to an embodiment of the present disclosure.

FIG. 4 illustrates a lateral view of the tactical rail engaging assembly 10. The sides of the tactical rail engaging assembly 10 may be minor images of one another. The rail locks 44 may include linear beams that extend between the lateral walls 32 within the lock channels 42. The rail locks 44 are operatively connected to the opposed buttons 40 that extend into the securing base 14 through the end walls 34. The rail locks 44 may abut into spring members 62 within an internal chamber of the securing base 14. As such, the rail locks 44 may be spring-biased into portions of the buttons 40. Thus, when the buttons 40 are pushed into the securing base 14, the buttons 40 force the rail locks 44 downwardly in the direction of arrow A. As the rail locks 44 are forced down, the engaging surfaces 60 (shown in FIG. 3, for example) of the rail locks 44 also move down toward the internal chamber of the securing base 14. At the same time, lower surfaces of the rail locks 44 are urged into the spring members 62, thereby compressing the spring members 62. When the buttons 40 are released, the stored energy in the compressed spring members 62 is released, returning the spring members 62 to their at-rest positions, forcing the rail locks 44 back up so that the engaging surfaces 60 extend into the rail-receiving channel 46 (shown in FIG. 3, for example), which, in turn, forces the buttons 40 out to at-rest positions.

Figure 5:
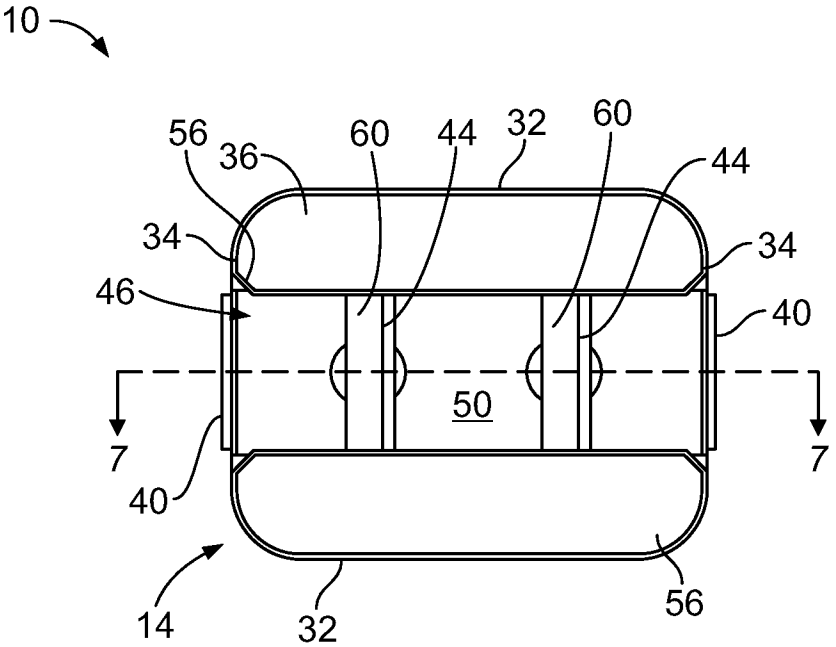
FIG. 5 illustrates a top view of a tactical rail engaging assembly, according to an embodiment of the present disclosure.

FIG. 5 illustrates a top view of the tactical rail engaging assembly 10. As shown in FIG. 5, the buttons 40 are shown in at-rest positions, in which tactile surfaces extend outwardly from the end walls 34. As shown, the rail locks 44 are in at-rest positions in which the engaging surfaces 60 extend above a plane of the flat surface 50 of the rail-receiving channel 46.

Figure 6:
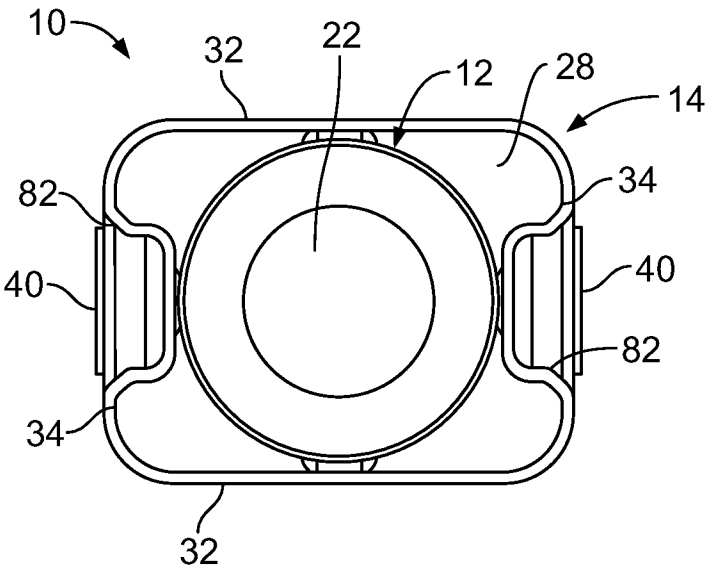
FIG. 6 illustrates a bottom view of a tactical rail engaging assembly, according to an embodiment of the present disclosure.

FIG. 6 illustrates a bottom view of the tactical rail engaging assembly 10. The bottom surface 28 of the securing base 14 may include cavities 82 formed through the end walls 34 and underneath the buttons 40. The cavities 82 provide clearance areas into which an individual may press the buttons 40 into the internal chamber of the securing base 14.

Figure 7:
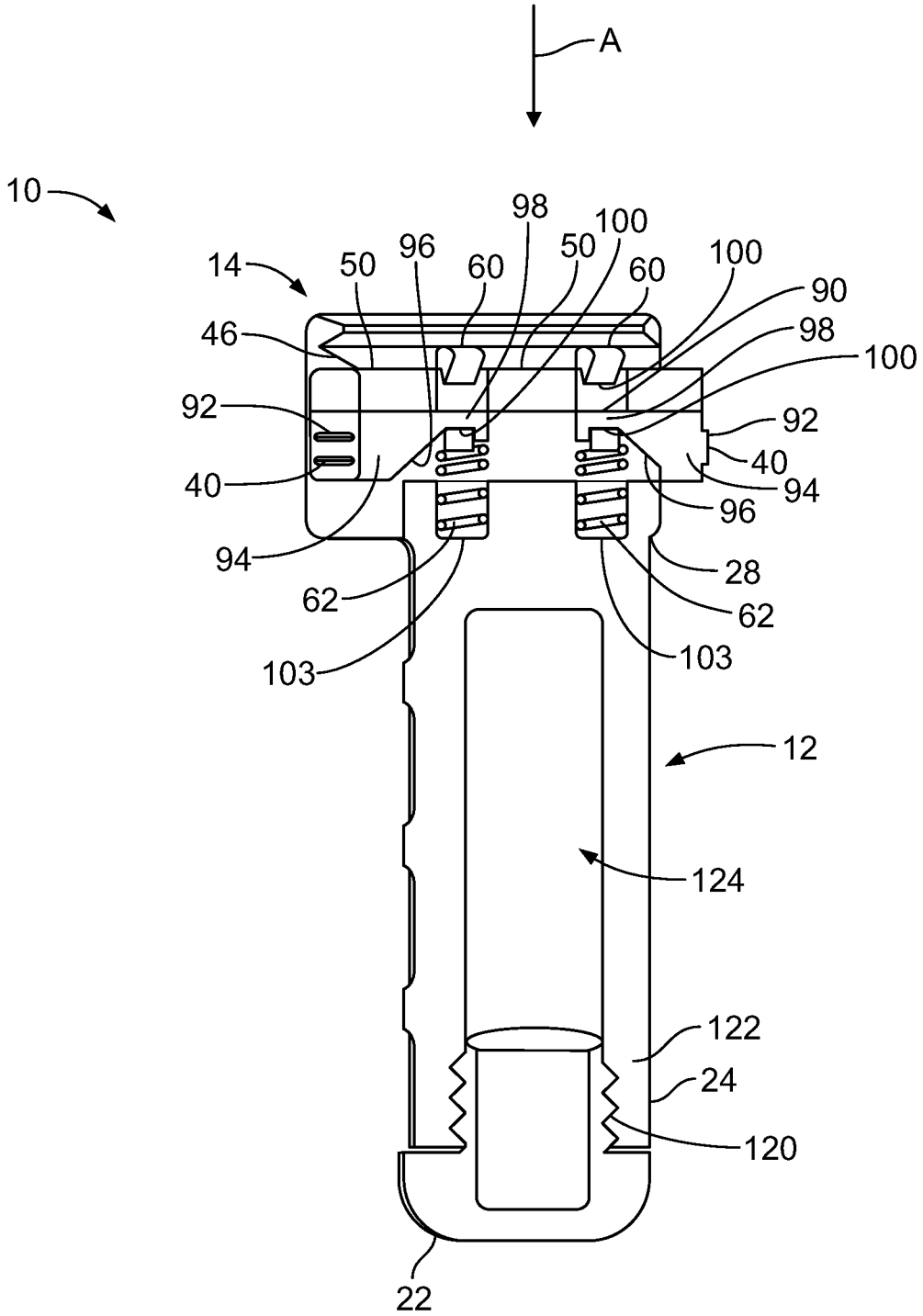
FIG. 7 illustrates a cross-sectional view of a tactical rail engaging assembly through line 7-7 of FIG. 5, according to an embodiment of the present disclosure.

FIG. 7 illustrates a cross-sectional view of the tactical rail engaging assembly 10 through line 7-7 of FIG. 5. The buttons 40 and the rail locks 44 extend into the internal chamber 90 of the securing base 14. Each button 40 may include an outer tactile surface 92 connected to an inboard main body 94 having a lower ramped surface 96 that angles upwardly from a lower edge main body 94. The lower ramped surface 96 integrally connects to a flat beam 98 that extends into a passage formed through the rail lock 44 and overlays an internal edge 100 of the rail lock 44. A hook portion 102 extends over a side of the rail lock 44 to ensure that the button 40 does not dislodge from the rail lock 44.

The spring members 62 may be coil springs retained within cavities 103 formed through the bottom surface 28 of the securing base 14. Upper ends of the spring members 62 abut into lower surfaces of the rail locks 44.

In operation, as the buttons 40 are pushed into the internal chamber 90, the ramped surfaces 96 slide over internal edges 100 of the rail locks 44, thereby forcing the rail locks 44 downwardly in the direction of arrow A. As the rail locks 44 continue to move downwardly, the engaging surfaces 60 of the rail locks 44 retreat into the internal chamber 90 towards a retracted state. The buttons 40 continue to be pushed inwardly until the engaging surfaces 60 are flush with (or below) the flat surface of the rail-receiving channel 46. In the retracted state, a securing platform of a tactical rail may be slid into the rail-receiving channel 46 and located at a desired position. After the tactical rail is moved to a desired position, the buttons 40 are released, and the spring members 62 decompress and force the rail locks 44 upwardly so that the engaging surfaces 60 extend upwardly into the rail-receiving channel 46 in an extended state, and the buttons 40 are forced back out. As such, the securing platform is locked in position with respect to the rail-receiving channel 46. As noted, the hook portions 102 ensure that the buttons 40 do not eject from the end walls 34.

Accordingly, an individual may secure a tactical rail to the tactical rail engaging assembly 10 by using one hand, and squeezing the buttons 40 inwardly. The individual then positions the tactical rail as desired, while continuing to press the buttons 40 inwardly. After the tactical rail is at a desired position, the individual releases the buttons 40, which causes the rail locks 44 to extend upwardly into the rail-receiving channel 46 and lock the tactical rail in position.

As noted above, the end cap 22 may be removably secured to the distal end 24 of the graspable member 12. The end cap 22 may include a threadable interface 120 that threadably engages an internal threadable interface 122 of the graspable member 12. A hollow interior chamber 124 may be formed within the graspable member 12. In order to gain access to the hollow interior chamber 124, an individual may unscrew the end cap 22 from the distal end. Small parts may be stored within the hollow interior chamber 124. For example, an individual may unscrew the end cap 22 from the distal end 24 and place various small parts or devices within the hollow interior chamber 124. Once the small parts are positioned within the hollow interior chamber 124, the individual may then screw the end cap 22 back onto the distal end 24, thereby containing the small parts or devices within the hollow interior chamber 124.

Figure 8:
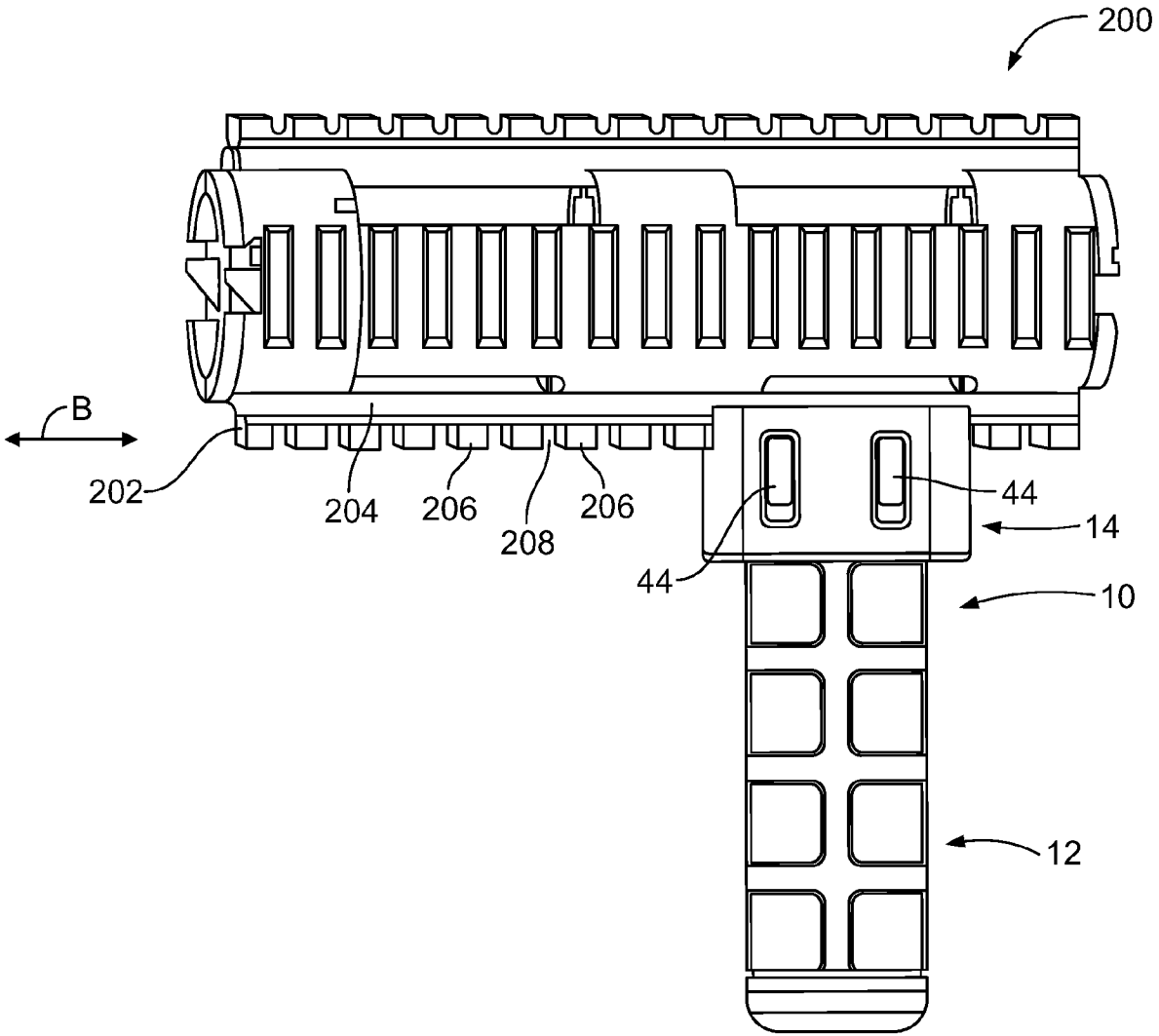
FIG. 8 illustrates a lateral view of a tactical rail engaging assembly secured to a tactical rail, according to an embodiment of the present disclosure.

FIG. 8 illustrates a lateral view of the tactical rail engaging assembly 10 secured to a tactical rail 200, according to an embodiment of the present disclosure. The tactical rail engaging assembly 10 and the tactical rail 200 form a system for securing a component, such as a foregrip, to another component, such as a barrel of a weapon. The tactical rail 200 may be a Picatinny rail, for example. The tactical rail 200 may be secured to a weapon, for example.

The tactical rail 200 includes at least one securing platform 202 having a longitudinal rail 204. Multiple securing ridges 206 extend outwardly from the securing platform 202. Referring to FIGS. 1-8, the ridges 206 are separated by gaps 208 that are sized to receive the engaging surfaces 60 of the rail locks 44. The ridges 206 are sized and shaped to be slid into the rail-receiving channel 46. For example, the securing platform 202 is configured to be slid into the rail-receiving channel 46 such that the ridges 206 may slide therein in directions denoted by arrow B.

Figure 9:
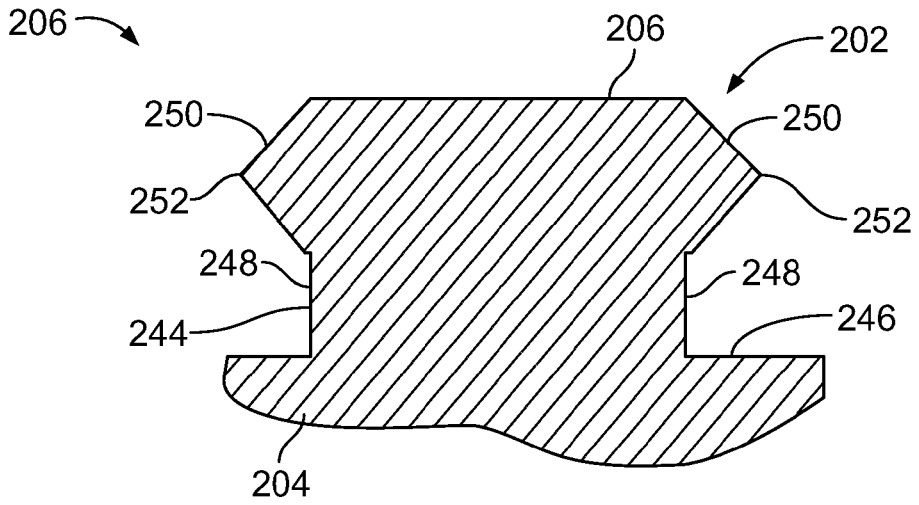
FIG. 9 illustrates a cross-sectional view of a ridge of a securing platform of a tactical rail, according to an embodiment of the present disclosure.
Figure 10:
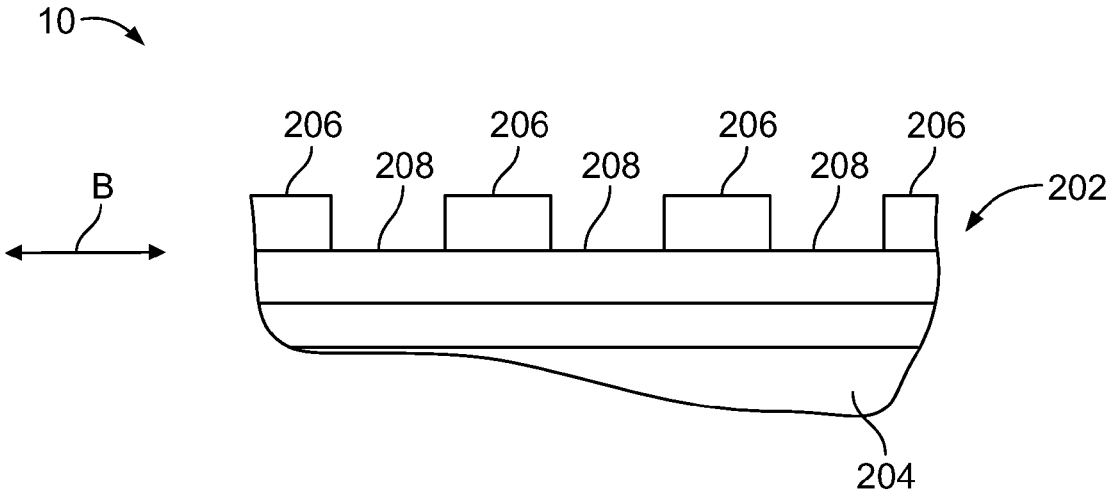
FIG. 10 illustrates a lateral view of a securing platform of a tactical rail, according to an embodiment of the present disclosure.

FIG. 9 illustrates a cross-sectional view of a ridge 206 of the securing platform 202 of the tactical rail 200, according to an embodiment of the present disclosure. FIG. 10 illustrates an end view of the securing platform 202 of the tactical rail 200. Referring to FIGS. 8-10, the securing platform 202 may include an extension stem 244 that upwardly extends from the rail 204. The extension stem 244 may generally be linear, having straight, vertical ends 248 that are perpendicular to a surface 246 of the rail 204. The extension stem 244 integrally connects to the ridge(s) 206. Each ridge 206 may include terminal ends 250 that outwardly extend from a vertical plane in which the extension stem 244 resides. The terminal ends 250 may include beveled or otherwise inwardly-angled tips 252.

Referring to FIGS. 3 and 8-10, the size and shape of the ridges 206 conform to the shape of the rail-receiving channel 46. Thus, when the ridges 206 are slid into the rail-receiving channel 46, the ledges 56 prevent the securing base 14 from shifting with respect to the ridges 206 in the directions of arrows A. Further, when the buttons 40 are disengaged, each rail lock 44 is configured to be retained between two ridges 206 in a gap 208, thereby preventing the tactical rail from shifting with respect to the securing base 14 in the directions of arrow B. Accordingly, the tactical rail engaging assembly 10 secures to the tactical rail 200. In order to adjust the tactical rail engaging assembly 10 with respect to the tactical rail 200, the buttons 40 may be engaged, as described above, and the tactical rail engaging assembly 10 may be slid with respect to the tactical rail to a desired position. Once the desired position has been attained, the buttons 40 are disengaged, and the tactical rail engaging assembly 10 locks in place.

The rail-receiving channel 46 may be sized and shaped differently, and the ridges 206 may be sized and shaped in a similar fashion. For example, the rail-receiving channel 46 may have a generally cylindrical shape, while the ridges 206 may be shaped as circular discs that fit within the rail-receiving channel 46.

Referring to FIGS. 1-10, embodiments of the present disclosure provide a tactical rail engaging assembly 10, such as a foregrip assembly, that is configured to mount to a tactical rail, such as a Picatinny rail system. The tactical rail engaging assembly 10 may be adjustably secured to the tactical rail. Unlike prior foregrips, for example, the tactical rail engaging assembly 10 may be quickly and easily adjusted with just one hand. For example, an individual may press opposed buttons 40 with a thumb and index finger, for example, and slide the tactical rail engaging assembly 10 with respect to the tactical rail. At a desired location, the buttons 40 are disengaged, and the tactical rail engaging assembly locks in place, as described above.

While the tactical rail engaging assembly 10 may be a foregrip assembly, the tactical rail engaging assembly 10 may be various other components, devices, accessories, or the like. For example, the tactical rail engaging assembly may be part of a scope, tactical light, laser-aiming module, grenade launcher, night vision devices, reflex sights, bipods, bayonets, or the like. For example, each device, components, accessory, or the like may include a securing base, such as the securing base 14, configured to adjustably secure to a tactical rail.

The securing base 14 includes opposed buttons 40. The buttons 40 are engaged to retract the rail locks 44 that are used to lock into and engage the tactical rail. The buttons 40 may include tactile features, such as ribs, embossments, or the like, which allow for easier manipulation when a user is wearing gloves.

Embodiments of the present disclosure provide a tactical rail engaging assembly 10 that is easy to adjust with respect to a tactical rail of a weapon, for example. Moreover, embodiments of the present disclosure may be easily used and adjusted while wearing gloves.

The tactical rail engaging assembly 10 may be formed of a polymer having a reduced infrared signature, for example. As such, the tactical rail engaging assembly 10 may be less visible through night vision goggles, for example. Additionally, embodiments may be formed from a polymer that is not easily fragmented. The tactical rail engaging assembly 10 may be formed through injection-molding, for example.

Figure 11:
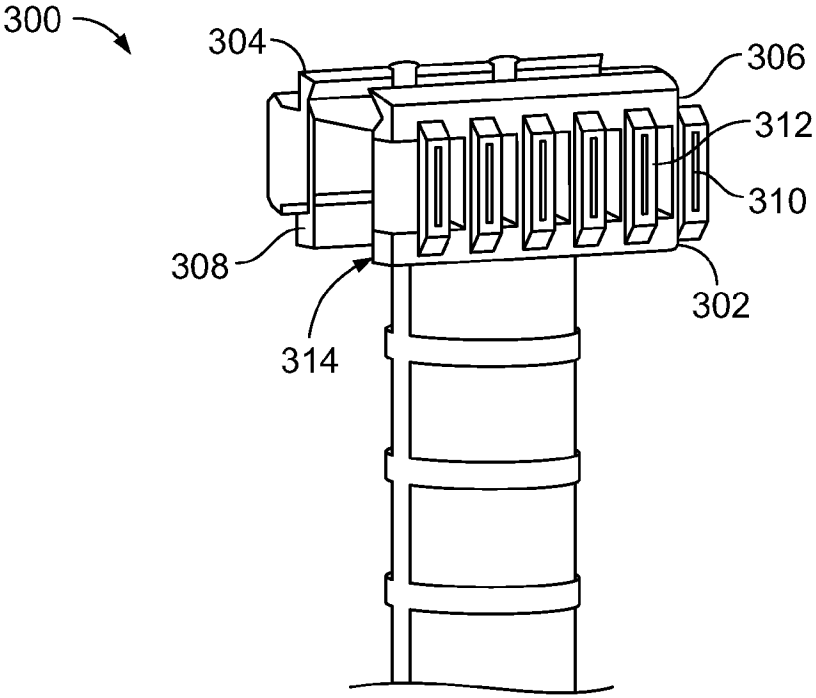
FIG. 11 illustrates a tactical rail engaging assembly from a first side, according to an embodiment of the present disclosure.

FIG. 11 illustrates a tactical rail engaging assembly 300 from a first side, according to an embodiment of the present disclosure. The tactical rail engaging assembly 300 may be similar to the tactical rail engaging assembly 10 (shown in FIGS. 1-8), except that the tactical rail engaging assembly 300 may include rail segments 302 and 304 secured to, or integrally part of, lateral walls 306 and 308, respectively. For the sale of clarity, the buttons and rail locks are not shown. The rail segments 302 may include securing ridges 310 separated by gaps 312, as described above with respect to FIGS. 8-10. The rail segments 302 and 304 may be compatible with Picatinny rail systems. The rail segment 302 may be integrally molded and formed with a securing base 314 as a single piece. The rail segment 304 may be a separate and distinct component that is secured to the securing base 314. Alternatively, both the rail segments 302 and 204 may be integrally molded and formed with the securing base 314 as a single piece. Additionally, alternatively, both the rail segments 302 and 304 may be separate and distinct pieces that are secured to the securing base 314.

Figure 12:
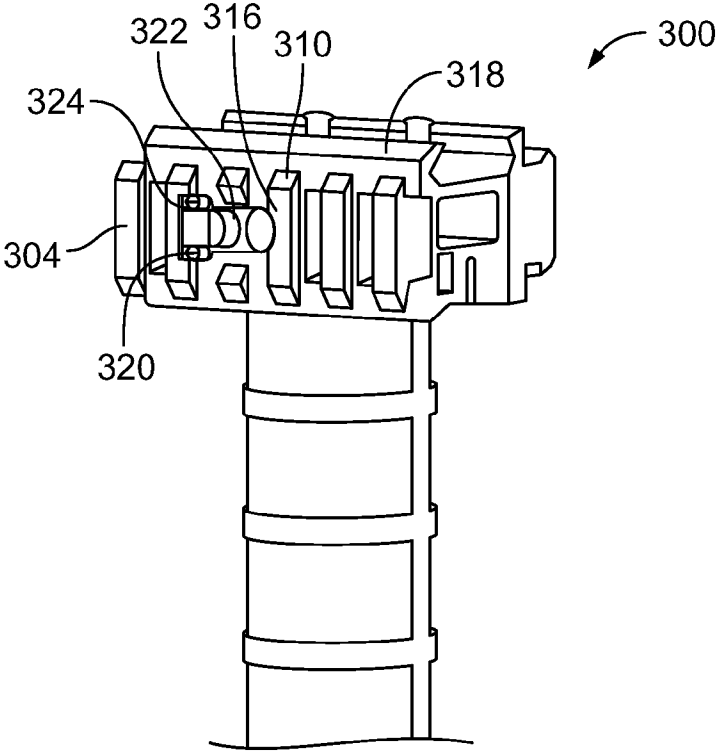
FIG. 12 illustrates a tactical rail engaging assembly from a second side, according to an embodiment of the present disclosure.
Figure 13:
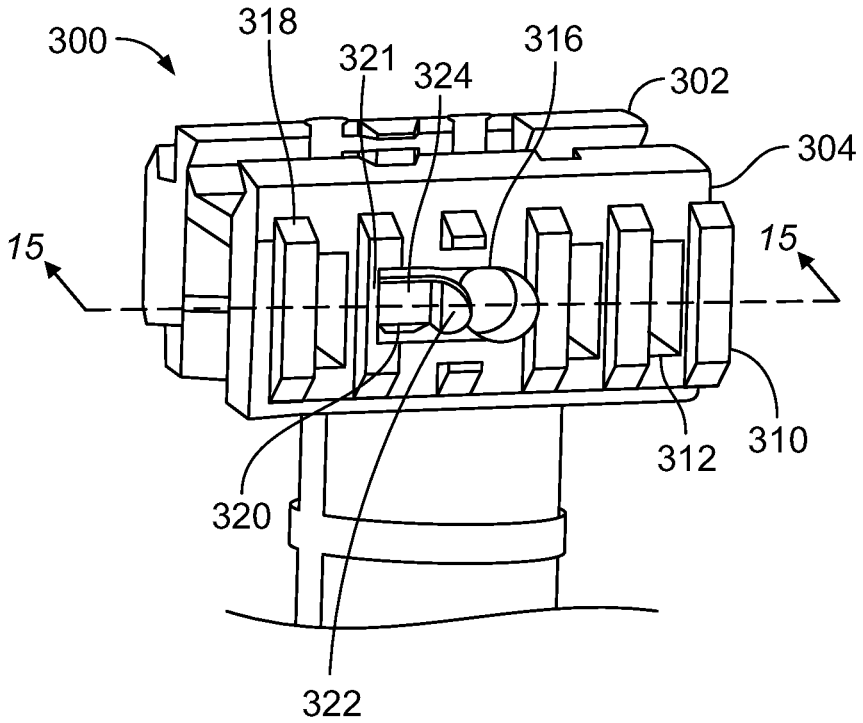
FIG. 13 illustrates an isometric lateral view of a securing base of a tactical rail engaging assembly, according to an embodiment of the present disclosure.

FIG. 12 illustrates the tactical rail engaging assembly 300 from a second side. FIG. 13 illustrates an isometric lateral view of the securing base 314 of the tactical rail engaging assembly 300. Referring to FIGS. 11-13, the rail segment 304 may include a longitudinal slot 316 formed through a body 318. A spring or pivot beam 320 extends from an internal edge 321 of the body 318 and terminates with a free stud 322 within the slot 316. The pivot beam 320 is generally free on three sides, but fixed to the body 318 by a base 324 connecting to the internal edge 321. Accordingly, the pivot beam 320 is configured to pivot within the slot 316.

The pivot beam 320 is generally perpendicular to the ridges 310. While the pivot beam 320 is shown such that the free stud 322 is generally at a mid-section of the rail segment 304, the pivot beam 310 may be at various other locations on the rail segment 304. Additionally, the rail segment 304 may include more than one pivot beam and free stud within a slot.

FIGS. 11-13 show the rail segment 304 as part of the tactical rail engaging assembly 300. However, the rail segment 304 may be part of a tactical rail, such as the tactical rail 200 (shown in FIG. 8).

The pivot beam 320 is configured to allow a component, such as a device, accessory, or the like, to be directly secured to the rail segment 304 without being slid over a substantial length of the rail segment 304. While not shown, the rail segment 302 may also include a pivot beam 320.

Figure 14:
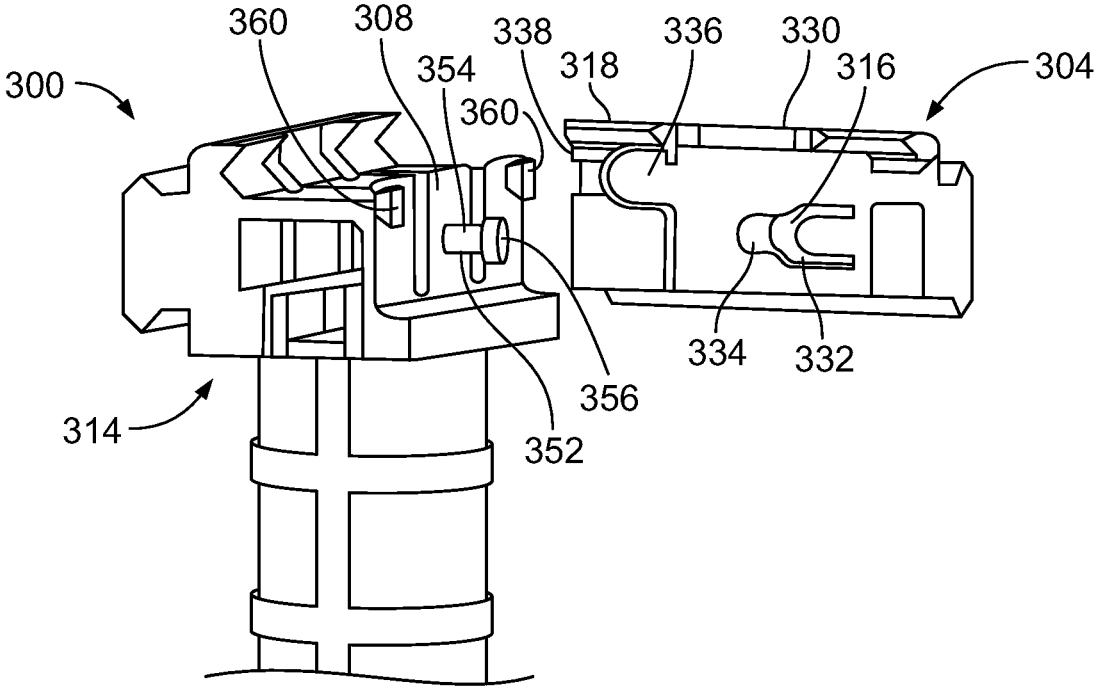
FIG. 14 illustrates an isometric lateral view of a rail insert removed from a securing base of a tactical rail engaging assembly, according to an embodiment of the present disclosure.

FIG. 14 illustrates an isometric lateral view of the rail segment 304 removed from the securing base 314 of the tactical rail engaging assembly 300, according to an embodiment of the present disclosure. The body 318 of the rail segment 304 include an interior surface 330. The slot 316 includes a beam area 332 that connects to a connecting channel, such as a reduced neck 334. Additionally, upper corners of the interior surface 330 may include wide areas 336 connected to connecting channels, such as reduced area necks 338. Alternatively, the rail segment 304 may include connection members, such as posts and securing anchors, while the lateral wall 308 includes reciprocal connection channels.

The lateral wall 308 of the securing base 314 includes a connection post 352 having a cylindrical extension 354 extending outwardly from the lateral wall 308. The cylindrical extension 354 includes a terminal disc 356 at a distal end thereof. The connection post 352 may be proximate to a middle of the lateral wall 308. Alternatively, the connection post 352 may be located at various other areas of the lateral wall 308.

Securing anchors 360 may extend outwardly from upper corners of the lateral wall 308. The securing anchors 360 and the connection post 352 are configured to securely retain the rail segment 304 to the lateral wall 308. The securing anchors 360 and the connection post 352 cooperate to provide three securing points for the rail segment 304. Alternatively, the rail segment 304 may not include the securing anchors 360. Also, alternatively, the rail segment 304 may include the securing anchors 360, but not the connection post 352.

Referring to FIGS. 13 and 14, the connection post 352 may be configured to slide into the reduced neck 334 of the rail segment 304. The terminal disc 356 seats over the reduced neck 334, thereby retaining the rail segment 304 to the lateral wall 308. Similarly, the securing anchors 360 are configured to be retained within the reduced area necks 338 in order to provide additional anchoring support for the rail segment 304.

Figure 15:
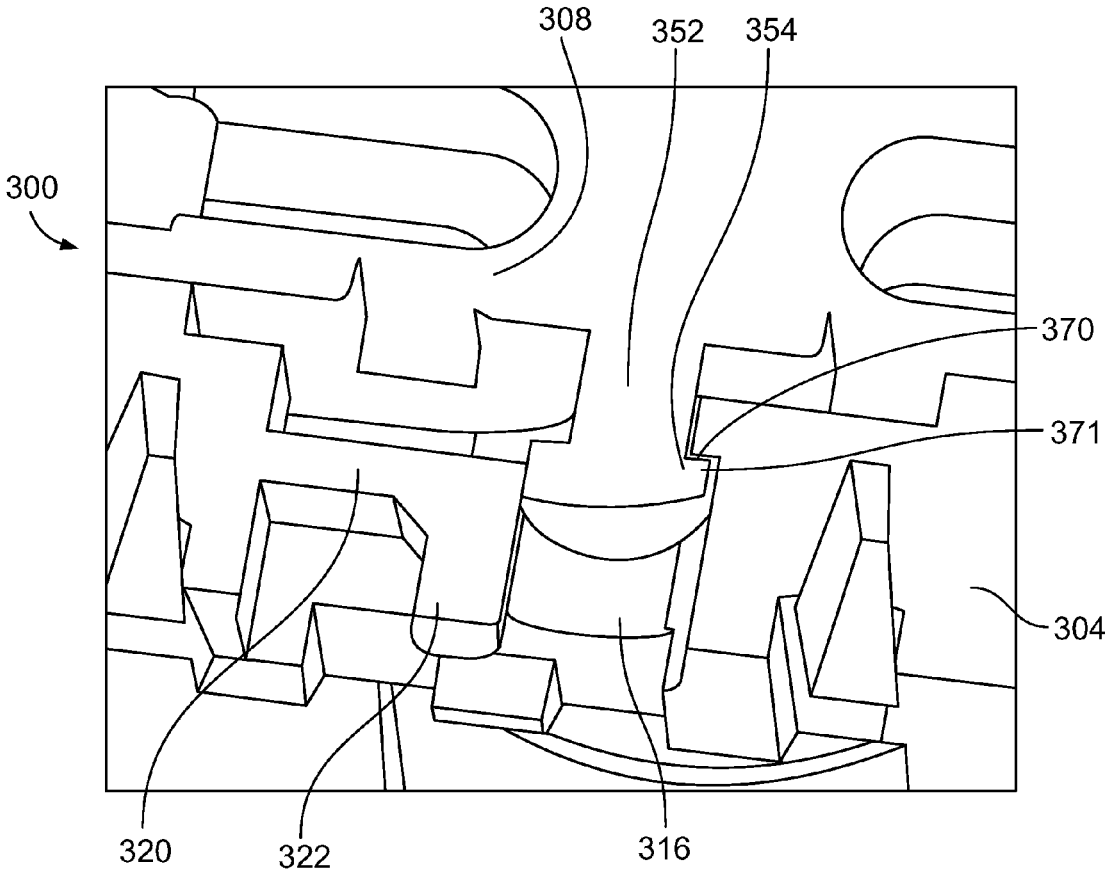
FIG. 15 illustrates a transverse cross-sectional view of a tactical rail engaging assembly through line 15-15 of FIG. 13, according to an embodiment of the present disclosure.

FIG. 15 illustrates a transverse cross-sectional view of the tactical rail engaging assembly 300 through line 15-15 of FIG. 13, according to an embodiment of the present disclosure. As shown, an internal edge surface 371 of the terminal disc 356 abuts into a ledge 370 of the slot 316, thereby securing the rail segment 304 to the lateral wall 308. Further, the free stud 322 abuts into an outer edge of the terminal disc 315, thereby locking the rail segment 304 in place.

Figure 16:
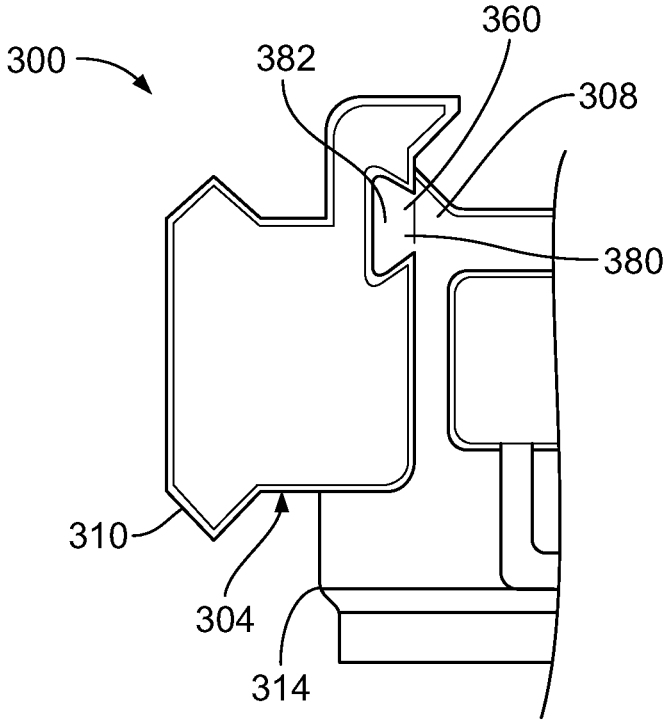
FIG. 16 illustrates a partial end view of a tactical rail engaging assembly, according to an embodiment of the disclosure.

FIG. 16 illustrates a partial end view of the tactical rail engaging assembly 300, according to an embodiment of the disclosure. The securing anchors 360 may include a narrow stem 380 integrally connected to an expanded head 382. The reduced necks 334 may include a reciprocal shape configured to receive and retain the securing anchors 360. The reduced necks 334 may be configured to snapably retain the securing anchors 360. Optionally, the securing anchors 360 may be slid into the reduced necks 334.

Figure 17:
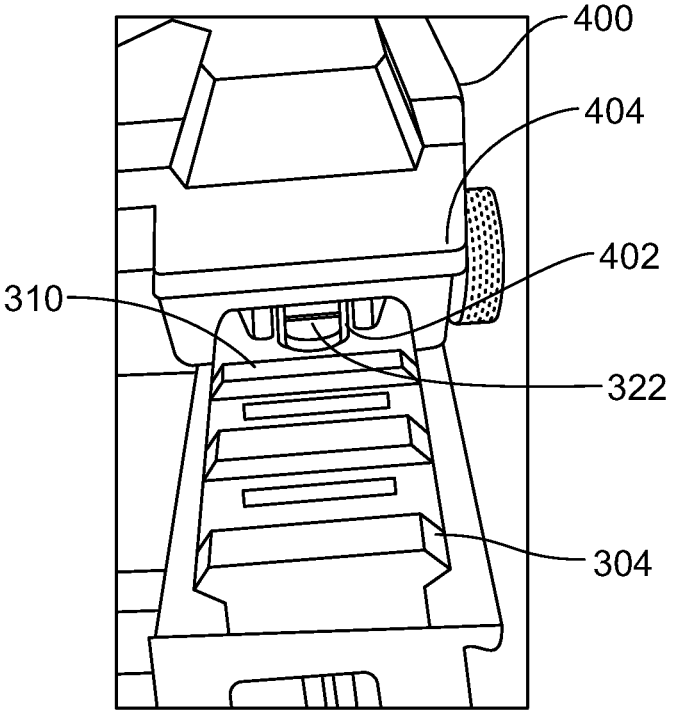
FIG. 17 illustrates an isometric view of an accessory secured to a rail insert of a tactical rail engaging assembly, according to an embodiment of the present disclosure.

FIG. 17 illustrates an isometric view of an accessory 400 secured to the rail segment 304 of the tactical rail engaging assembly 300, according to an embodiment of the present disclosure. Referring to FIGS. 11-17, in operation, the accessory 400 may be secured to the rail segment 304 by initially aligning a receiving passage 402 formed through a base 404 of the accessory 400 with the ridges 310. The accessory 400 may include a cavity (not shown) configured to receive and retain the free stud 322 extending outwardly from the rail segment 304. As the accessory 400 is moved over the rail segment, the pivot beam 320 pivots toward the lateral wall 308 until the cavity of the accessory encounters the free stud 322. The free stud 322 snaps into the cavity when the pivot beams 320 moves back into its at-rest position. As such, an accessory, device, component, or the like, may be secured to the rail segment 304.

Optionally, instead of a cavity, the accessory 400 may include a peg or the like extending from an underside thereof. The peg may be configured to be retained over the terminal disc 356 and between an end of the free stud 322 and an internal distal end of the slot 316.

In order to remove the accessory 400, the pivot arm 320 is engaged, such as with a separate tool or finger, and pushed toward the lateral wall 308 so that the free stud 322 no longer engages the cavity or peg of the accessory 400. In this manner, the free stud 322 may be removed from a securing connection with the accessory 400. The accessory may then be slid off the rail segment 304.

Additionally, the accessory 400 may be removed by sliding the rail segment 304 off the lateral wall 308 so that the terminal disc 356 and anchors 360 disengage from the rail segment 304. Once the rail segment 304 is removed, an individual may bend the pivot arm 320 so that the free stud 322 no longer securely engages a portion of the accessory 400. The accessory 400 may then be slid off the rail segment 304. In this manner, the free stud 322 may be removed from a securing connection with the accessory 400. The rail segment 304 may then be re-secured to the lateral wall 308.

Accordingly, the accessory 400 is protected from being accidentally released from the rail segment 304. As noted above, in order to remove the accessory 400 from the rail segment 304, a separate tool or finger is used to engage the pivot arm 320, and/or the rail segment 304 is removed from the lateral wall 308 by disengaging it from three points of securing contact with the lateral wall 308. Accordingly, the likelihood of the accessory being inadvertently knocked off the rail segment 304 is eliminated or otherwise reduced.

The connection post 352 and the securing anchors 360 cooperate to protect the rail segment 304 from peeling away from the lateral wall 308. More or less connection members may be used. For example, additional securing anchors at lower corners of the lateral wall 308 may be used. Additionally, more connection posts 352 than shown may be used.

As noted, any of the tactical rails noted above may include a connecting member, such as the pivot beam 320 and free stud 322 as described above. The connecting member is not limited to use on just a tactical rail engaging assembly, such as the assembly 300.

Thus, embodiments of the present disclosure provide a rail segment that may be used to securely and reliably retain a component, such as an accessory, device, or the like. The component may be secured to the rail segment without having to be slid over a substantial length of the rail segment.

The rail segment may be part of a tactical rail engaging assembly. The rail segment may alternatively be part of a tactical rail, such as a Picatinny rail system, for example.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

Various features of the disclosure are set forth in the following claims.

The invention claimed is:

1. A tactical rail engaging assembly configured to securely engage a tactical rail, the tactical rail engaging assembly comprising:

a securing base having opposed first and second lateral walls connected to opposed first and second end walls, wherein a rail-receiving channel is formed through a surface of the securing base;

at least one button formed through at least one of the first and second end walls; and at least one rail lock extending between the first and second lateral walls and having at least one surface extending into the rail-receiving channel in an extended state, wherein the at least one button is operatively connected to the at least one rail lock, wherein the at least one button is configured to be engaged to move the at least one surface of the at least one rail lock from the extended state to a retracted state in order to allow at least a portion of the tactical rail to move within the rail-receiving channel relative to the securing base;

at least one rail segment extending from one or both of the first and second lateral walls, wherein the at least one rail segment is configured to securely retain a component, wherein the at least one rail segment comprises a body having a slot and a pivot beam extending into the slot, wherein the pivot beam includes a free stud at a terminal end, and wherein a component is configured to connect to the body through, at least in part, the free stud.

2. The tactical rail engaging assembly of claim 1, wherein the at least one button comprises first and second buttons located at the first and second end walls, respectively.

3. The tactical rail engaging assembly of claim 1, wherein the at least one rail lock comprises first and second rail locks extending between the first and second lateral walls.

4. The tactical rail engaging assembly of claim 1, further comprising at least one spring member abutting into at least a portion of the at least one rail lock.

5. The tactical rail engaging assembly of claim 1, further comprising a graspable member connected to the securing base.

6. The tactical rail engaging assembly of claim 5, further comprising an end cap removably secured to the graspable member, wherein the graspable member includes a hollow interior chamber closed by the end cap.

7. The tactical rail engaging assembly of claim 1, wherein the at least one rail segment is integrally formed with the one or both of the first and second lateral walls.

8. The tactical rail engaging assembly of claim 1, wherein the at least one rail segment is removably secured to the one or both of the first and second lateral walls.

9. The tactical rail engaging assembly of claim 8, wherein the one or both of the first and second lateral walls comprises a connection post and first and second securing anchors, and wherein the at least one rail segment securely connects to the one or both of the first and second lateral walls through the connection post and the first and second securing anchors.

10. A tactical rail engaging assembly configured to securely engage a tactical rail, the tactical rail engaging assembly comprising:

a securing base having opposed first and second lateral walls connected to opposed first and second end walls, wherein a rail-receiving channel is formed through a surface of the securing base, wherein the rail-receiving channel is configured to receive a at least a portion of the tactical rail;

a first rail segment extending from the first lateral wall; and a second rail segment extending from the second lateral wall, wherein each of the first and second rail segments is configured to securely retain a component, wherein one or both of the first and second lateral walls comprises a connection post and first and second securing anchors, and wherein one or both of the first and second rail segments securely connects to the one or both of the first and second lateral walls through the connection post and the first and second securing anchors.

11. The tactical rail engaging assembly of claim 10, wherein each of the first and second rail segments is integrally formed with the first and second lateral walls, respectively.

12. The tactical rail engaging assembly of claim 10, wherein one or both of the first and second rail segments is removably secured to one or both of the first and second lateral walls, respectively.

13. The tactical rail engaging assembly of claim 10, wherein the one or both of the first and second rail segments comprises connection channels configured to securely connect to the connection post and the first and second securing anchors, wherein the connection channels comprise one or more of reciprocal channels formed through or within one or both of the first and second rail segments.

14. The tactical rail engaging assembly of claim 10, wherein one or both of the first and second rail segments comprises a body having a slot and a pivot beam extending into the slot, wherein the pivot beam includes a free stud at a terminal end, and wherein the component is configured to connect to the body through, at least in part, the free stud.

15. A tactical rail engaging assembly configured to securely engage a tactical rail, the tactical rail engaging assembly comprising:

a securing base having opposed first and second lateral walls connected to opposed first and second end walls, wherein a rail-receiving channel is formed through a surface of the securing base, wherein the rail-receiving channel is configured to receive a at least a portion of the tactical rail;

a first rail segment extending from the first lateral wall; and a second rail segment extending from the second lateral wall, wherein each of the first and second rail segments is configured to securely retain a component, wherein one or both of the first and second rail segments comprises a body having a slot and a pivot beam extending into the slot, wherein the pivot beam includes a free stud at a terminal end, and wherein the component is configured to connect to the body through, at least in part, the free stud.

16. The tactical rail engaging assembly of claim 15, wherein each of the first and second rail segments is integrally formed with the first and second lateral walls, respectively.

17. The tactical rail engaging assembly of claim 15, wherein one or both of the first and second rail segments is removably secured to one or both of the first and second lateral walls, respectively.

18. A tactical rail engaging assembly configured to securely engage a tactical rail, the tactical rail engaging assembly comprising:

a securing base having opposed first and second lateral walls connected to opposed first and second end walls, wherein a rail-receiving channel is formed through a surface of the securing base;

at least one button formed through at least one of the first and second end walls;

at least one rail lock extending between the first and second lateral walls and having at least one surface extending into the rail-receiving channel in an extended state, wherein the at least one button is operatively connected to the at least one rail lock, wherein the at least one button is configured to be engaged to move the at least one surface of the at least one rail lock from the extended state to a retracted state in order to allow at least a portion of the tactical rail to move within the rail-receiving channel relative to the securing base; and at least one rail segment extending from one or both of the first and second lateral walls, wherein the at least one rail segment is configured to securely retain a component, wherein the at least one rail segment is removably secured to the one or both of the first and second lateral walls, wherein the one or both of the first and second lateral walls comprises a connection post and first and second securing anchors, and wherein the at least one rail segment securely connects to the one or both of the first and second lateral walls through the connection post and the first and second securing anchors.

* * * * *